United States Patent [19]

Fisher et al.

[11] 3,970,382

[45] July 20, 1976

[54] SPATIALLY SELECTIVE OPTICAL SYSTEM

[75] Inventors: Donald H. Fisher, Marion; Vincent J. Crociata, Webster, both of N.Y.

[73] Assignee: Xerox Corporation, Stamford, Conn.

[22] Filed: Sept. 16, 1974

[21] Appl. No.: 506,653

Related U.S. Application Data

[63] Continuation of Ser. No. 375,276, June 29, 1973.

[52] U.S. Cl. ..... 355/4; 96/27 E; 96/44; 96/90 PC; 350/160 P; 355/8; 355/11; 355/71

[51] Int. Cl.² ..... G03G 15/052

[58] Field of Search ..... 350/311, 314, 160 P; 355/3 R, 3 P, 4, 8, 11, 32–38, 67–69, 71; 240/1.1, 3.1; 96/1 R, 1.2, 10, 27 E, 90 PC, 44; 354/296; 353/97; 313/109

[56] References Cited

UNITED STATES PATENTS

| | | | |
|---|---|---|---|
| 3,083,614 | 4/1963 | Veit | 355/38 |
| 3,085,469 | 4/1963 | Carlson | 355/37 |
| 3,105,761 | 10/1963 | Foris | 96/27 E |
| 3,260,152 | 7/1966 | Aston | 355/35 |
| 3,270,639 | 9/1966 | Windsor | 350/160 P X |
| 3,438,704 | 4/1969 | Schoen | 355/68 X |
| 3,454,778 | 7/1969 | Eisner | 350/160 P X |
| 3,722,998 | 3/1973 | Morse | 355/71 |
| 3,775,006 | 11/1973 | Hartman et al. | 355/4 |
| 3,779,640 | 12/1973 | Kidd | 355/4 X |

*Primary Examiner*—L. T. Hix
*Assistant Examiner*—Kenneth C. Hutchison
*Attorney, Agent, or Firm*—H. Fleischer; J. J. Ralabate; C. A. Green

[57] ABSTRACT

An optical system in which a light image of an original document is filtered to form a single color light image which is transmitted through a photochromic filter. The photochromic filter is responsive to the intensity of the single color light image to automatically regulate the intensity of the single color light image transmitted therethrough.

9 Claims, 2 Drawing Figures

SPATIALLY SELECTIVE OPTICAL SYSTEM

This is a continuation of application Ser. No. 375,276, filed June 29, 1973.

BACKGROUND OF THE INVENTION

This invention relates generally to an electrophotographic printing machine, and more particularly concerns an optical system adapted to attenuate the spectral energy distribution of the light rays being transmitted therethrough.

In the process of electrophotographic printing, a photoconductive surface is uniformly charged and exposed to a light image of the original document. Exposure of the photoconductive surface creates an electrostatic latent image corresponding to the original document. Toner particles are then electrostatically attracted to the latent image to render it viewable. Subsequently, the toner powder image is transferred to a sheet of support material and permanently affixed thereto so as to produce a copy of the original document. The foregoing process is described in detail in U.S. Pat. No. 2,297,691 issued to Carlson in 1942.

Multi-color electrophotographic printing is substantially identical to the heretofore discussed process of black and white printing with the following distinctions. Rather than forming a total light image of the original, the light image is filtered producing a single color light image which is a partial light image of the original. The foregoing single color light image exposes the charged photoconductive surface to create a single color electrostatic latent image. This single color electrostatic latent image is developed with toner particles of a color complementary to the single color light image. The single color toner powder image is transferred from the electrostatic latent image to a sheet of support material. This process is repeated a plurality of cycles with differently colored light images and the respective complementary colored toner particles. Each single color toner powder image is transferred to the sheet of support material in superimposed registration with the prior toner powder image. In this manner, a composite multi-powder image is produced on the sheet of support material. This multi-color powder image is coalesced and permanently affixed to the sheet of support material forming a color copy.

In multi-color electrophotographic printing, the density of the toner particles deposited on the photoconductive surface, i.e. the electrostatic latent image, is dependent upon the voltage level of the development system and that of the electrostatic latent image. Toner particles are attracted to those areas of the photoconductive surface having a voltage thereon greater than that of the development system. The areas of the photoconductive surface irradiated by the single color light are discharged. The degree of discharge is dependent upon the intensity of the light rays impinging thereon. Hence, the photoconductive surface will have a charge gradient thereon, those areas having a charge greater than the voltage level of the development system will attract toner particles thereto, while those areas having a charge less than the voltage level of the development system will not attract toner particles thereto. The voltage level of the development system is selected so that the undesired light rays transmitted from the original document remain undeveloped. This frequently produces a substantial gradient between the voltage level of the development system and the discharge regions of the photoconductive surface increasing the possibility of arcing, toner concentration, carrier bead stickage and trail edge deletion effects. Furthermore, it reduces the total potential gradient available for development. System developability may be appreciably improved by reduction of the voltage level of the development system so as to increase the voltage gradient between those areas of the photoconductive surface having a charge greater than the development system, which decreases the voltage gradient between those areas of the photoconductive surface having a charge less than the development system. However, the voltage level of the development system may only be reduced by eliminating the unwanted low density light rays.

Accordingly, it is a primary object of the present invention to improve the optical system by attenuating the low density light rays transmitted therethrough.

SUMMARY OF THE INVENTION

Briefly stated, and in accordance with the present invention, there is provided a spatially selective optical system.

This is accomplished in the present instance by light image creating means, filtering means and photochromic means. The image creating means forms a light image of an original document which is transmitted to the filtering means. In this manner, a single color light image of the original document is created. Thereafter, the single color light image passes through the photochromic means. The photochromic means is responsive to the single color light image transmitted thereto for automatically regulating the intensity of the single color light image passing therethrough.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment, it will be understood that it is is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
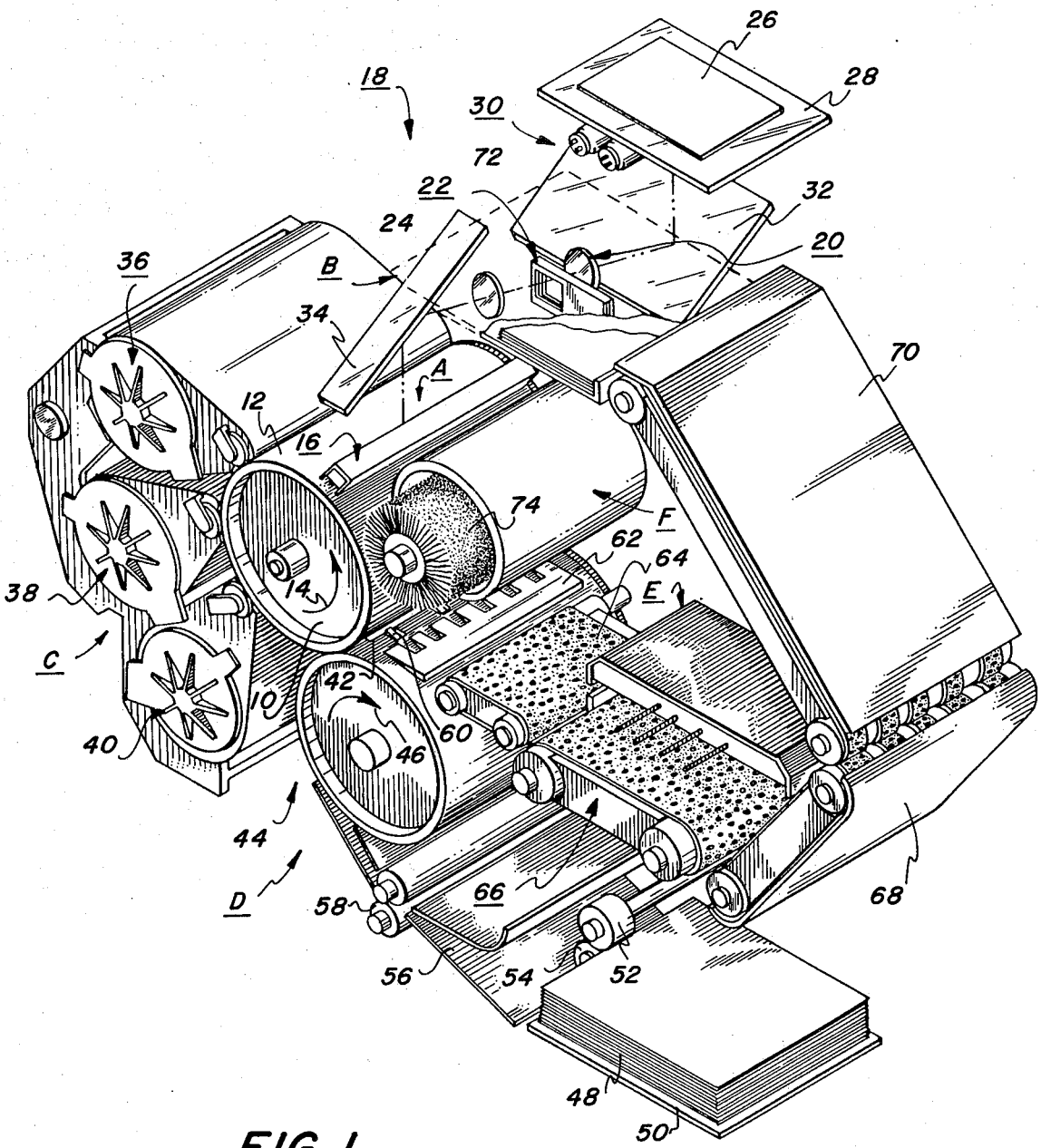
FIG. 1 is a schematic perspective view of a multi-color electrophotographic printing machine incorporating the features of the present invention therein.

With continued reference to the drawings, FIG. 1 schematically illustrates a color electrophotographic printing machine employing the present invention therein. In the drawings, like reference numerals have been used throughout to designate like elements. The multi-color electrophotographic printing machine shown schematically in FIG. 1 illustrates the various components utilized therein to produce color copies from a colored original. Although the optical system of the present invention is particularly well adapted for use in a multi-color electrophotographic printing machine, it will become evident from the following description that it is well suited for use in a wide variety of printing machines and is not necessarily limited to the particular embodiment shown herein.

As shown in FIG. 1, the printing machine employs a drum 10 having a photoconductive surface 12 secured to and entrained about the exterior circumferential surface thereof. Drum 10 is mounted rotatably within the machine (not shown). A series of processing stations are disposed such that as drum 10 rotates in the direction of arrow 14, photoconductive surface 12 passes sequentially therethrough. Drum 10 is driven at a predetermined speed relative to the other machine operating mechanisms by a drive motor (not shown). One type of photoconductive material is disclosed in U.S. Pat. No. 3,655,377 issued to Sechak in 1972. A timing wheel is mounted in the region of one end of drum 10 and adapted to trigger the logic circuitry of the printing machine. This coordinates the various another operations with one anaother to produce the proper sequence of events at the various processing stations.

Initially, drum 10 moves photoconductive surface 12 through charging station A. A corona generating device, indicated generally at 16, is disposed at charging station A. Corona generating device 16 extends in a generally longitudinal direction transversely across photoconductive surface 12. This readily enables corona generator 16 to charge photoconductive surface 12 to a relatively high substantial uniform potential. Preferably, corona generating device 16 is of the type described in U.S. Pat. No. 2,778,946 issued to Mayo in 1957.

Drum 10, thereafter, is rotated to exposure station B. Exposure station B includes thereat the optical system of the present invention, generally designated by the reference numeral 18. Optical system 18 includes a moving lens system, generally designated by the reference numeral 20, a color filter, shown generally at 22, and a photochromic filter, shown generally at 24. An original 26 is disposed upon transparent viewing platen 28. Lamps 30 are positioned beneath transparent platen 28 so as to illuminate original document 26. Lamps 30, lens 20, filter 22 and photochromic filter 24 move in a timed relation with drum 10 to scan successive incremental areas of original document 26 disposed upon platen 28. Mirror 32 reflects the light rays reflected from original document 26 through lens 20. After passing through lens 20, the light rays are transmitted through filter 22, i.e. a selected color separation filter inserted into the path of the light rays. Thereafter, the light rays pass through photochromic filter 24 which attenuates the light rays from high intensity inputs to a greater extent than the light rays from the low intensity inputs. Thereupon, after passing through photochromic filter 24, the light rays are reflected from a second mirror 34 onto photoconductive surface 12 of drum 10 to selectively dissipate the charge thereon in the irradiated areas to form a single color electrostatic latent image. As heretofore indicated, the appropriate color filter operates on the light rays passing through lens 20 to record an electrostatic latent image on photoconductive surface 12 corresponding to a preselected spectral region of the electromagnetic wave spectrum, hereinafter referred to as a single color electrostatic latent image. Optical system 18 will be discussed, in detail, with reference to FIG. 2.

With continued reference to FIG. 1, after exposure, drum 10 rotates the single color electrostatic latent image recorded on photoconductive surface 12 to development station C. Development station C includes thereat three individual developer units, generally indicated by reference numerals 36, 38, and 40 respectively. Preferably, the developer units are all of a type generally referred to as magnetic brush developer units. A typical magnetic brush developer unit utilizes a magnetizable developer mix having carrier granules and toner particles. The developer mix is continually brought through a directional flux field to form a brush thereof. Each developer unit includes a developer roll electrically biased to the appropriate potential such that the toner particles are attracted from the carrier granules to the areas of photoconductive surface 12 having a greater charge thereon, i.e. the single color electrostatic latent image. The single color electrostatic latent image recorded on photoconductive surface 12 is developed by bringing the brush of the developer mix into contact therewith. Each of the respective developer units contain discretely colored toner particles corresponding to the complement of the spectral region of the wave length of light transmitted through filter 22, e.g. a green filtered electrostatic latent image is rendered visible by depositing green absorbing magenta particles thereon, blue and red latent images are developed with yellow and cyan toner particles, respectively.

Drum 10 is next rotated to transfer station D where the toner powder image adhering electrostatically to photoconductive surface 12 is transferred to a sheet of support material 42. Support material 42 may be plain paper, or a sheet of transparent, thermoplastic material. A transfer roll, shown generally at 44, rotates support material 42 in the direction of arrow 46. Transfer roll 44 is electrically biased to a potential of sufficient magnitude and polarity to electrostatically attract toner particles from photoconductive surface 12 to support material 42. U.S. Pat. No. 3,612,677, issued to Langdon et al., in 1972, discloses a suitable electrically biased transfer roll. Transfer roll 44 is arranged to rotate in synchronism with drum 10, i.e. transfer roll 44 and drum 10 rotate at substantially the same angular velocity and have substantially the same outer diameter. Inasmuch as support material 42 is secured to transfer roll 44, for movement therewith in a recirculating path, successive toner powder images may be transferred from photoconductive surface 12 to support material 42 in superimposed registration with one another. Hence, a multi-layer toner powder image is formed on support material 42.

Referring once again to FIG. 1, the sheet feeding path for advancing support material 42 to transfer roll 44 will be briefly described. A stack 48 of support material 44 is supported on tray 50. Feed roll 52, operatively associated with retard roll 54, separates and advances the uppermost sheet from stack 48. The advancing sheet moves into chute 56 and is directed into the nip of register roll 58. Next, gripper fingers 60, mounted on transfer roll 44, releasably secure thereto support material 42 for movement therewith in the recirculating path.

After substantially all of the discretely colored toner powder images have been transferred to support material 42, gripper fingers 60 space support material 42 from transfer roll 44. This enables stripper bar 62 to be interposed between support material 42 and transfer roll 44 separating support material 42 therefrom. After support material 42 is stripped from transfer roll 44, it is moved on endless conveyor belt 64 to fixing station E.

At fixing station E, a suitable fuser, indicated generally at 66, heats the multi-layered powder image to affix it to support material 42. A typical fuser is described in U.S. Pat. No. 3,498,592 issued to Moser in 1970. After the multi-layered toner powder image is fixed to support material 42, endless belt conveyors 68 and 70 advance support material 42 to catch tray 72. Catch tray 72 permits the machine operator to readily remove the final multi-color copy from the printing machine.

Invariably, residual toner particles remain on photoconductive surface 12 after the transfer of the toner powder image therefrom to support material 42. These residual toner particles are removed from photoconductive surface 12 as it passes through cleaning station F. At cleaning station F, residual toner particles are initially brought under the influence of a cleaning corona generating device (not shown) adapted to neutralize the electrostatic charge remaining on the residual toner particles and photoconductive surface 12. The neutralized toner particles are then removed from photoconductive surface 12 by rotatably mounted brush 74. A suitable brush cleaning device is described in U.S. Pat. No. 3,590,412 issued to Gerbasi in 1971. Thus, the residual toner particles remaining on photoconductive surface 12 after each successive transfer operation are readily removed therefrom.

Figure 2:
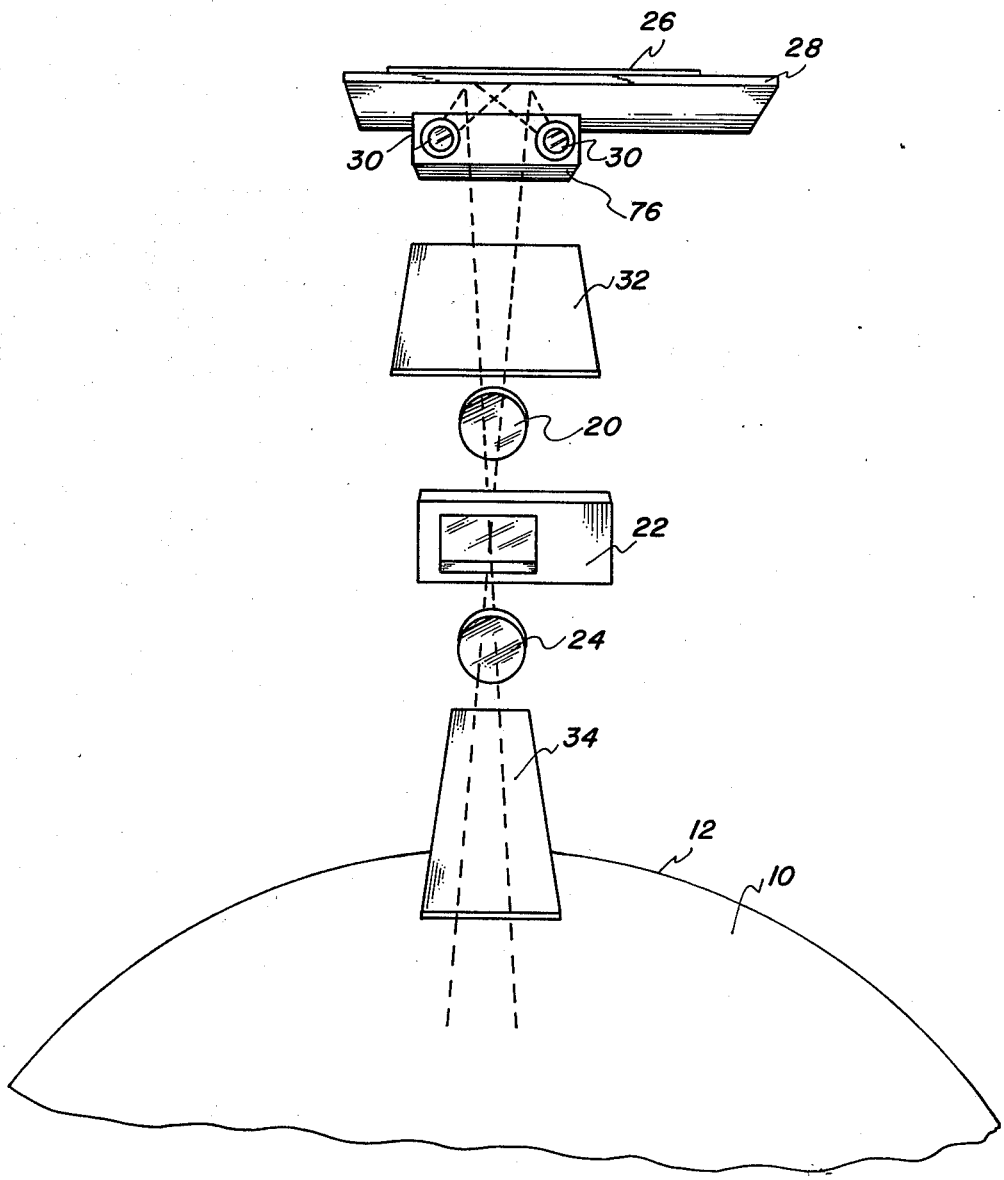
FIG. 2 is a schematic illustration of the optical system of the FIG. 1 printing machine.

Referring now to FIG. 2, there is shown lamp carriage 76 supporting a pair of light sources or lamps 30 thereon. Lamp carriage 76 is arranged to tranverse platen 28 illuminating incremental widths of original document 26 disposed thereon. Lamp carriage 76 is mounted by suitable means and driven by a cable pully system from the motor (not shown) driving drum 10. As lamp carriage 76 traverses platen 28, another cable pulley acts to also move lens 20 at a correlated speed therewith on suitable rollers surrounding a shaft (not shown). Filter assembly 22 is mounted by a suitable bracket on lens 20 so as to move therewith. In addition, photochromic filter 24 is also mounted by a suitable bracket on lens 20 and is interposed between filter 22 and photoconductive surface 12. Lens 20, filter 22, and photochromic filter 24 scan original document 26 to create a single color flowing light image thereof. Upon reaching the end of the scan path of platen 28, lens 20, filter 22, and photochromic 24, are spring biased to return to their original position and to again scan platen 28 for the start of a new cycle. It should be clear that the movement lens 20, filter 22, and photochromic filter 24 as well as lamps 30 is correlated with the speed of rotation of drum 10 for exposure of photoconductive surface 12. For greater details regarding the optical system described in FIG. 2 and its cooperation with the movement of drum 10, reference is made to U.S. Pat. No. 3,062,109 issued to Mayo et al. in 1962.

Preferably, lens 20 is a six element split dagor type lens system having front and back compound lens components with a centrally located diaphragm therebetween. The lens system forms high quality images with a field angle of 31° and a speed of F 4.5 at 1:1 magnification. In addition, the lens is designed to minimize the effect of secondary color at the image plane. The front lens component has three lens elements including the following order, a first lens element of positive power, a second lens element of negative power cemented to the first lens element, and a third lens element of positive power disposed between the second lens element and diaphragm. The back lens component also has three similar lens elements positioned so that lens 20 is symmetrical. In a specific embodiment of the lens, the first lens element in the front component is a double convex lens, the second lens element a lens concave lens, and the third lens element a convex-concave lena element. For greater details regarding lens 20, reference is made to U.S. Pat. No. 3,592,531 issued to McCrobie in 1971.

Referring once again to FIG. 2, filter 22 comprises a housing which is mounted on lens 20 by a suitable bracket and moves with lens 20 during scanning as a single unit. The housing of filter 22 includes a window which is positioned relative to lens 20 to allow the light reflected from original document 26 on platen 28 to pass therethrough to photochromic filter 24. The bottom and top walls of the housing member include a plurality of tracks which extend the entire width thereof. Each track is adapted to carry a filter and filter frame in a manner to allow movement of the filter from an inoperative position to an operative position interposed in the window of the housing to allow light rays to pass therethrough. The individual filters are mounted in a frame and made of any suitable filter material, such as a coated glass. The number of filters utilized in the electrophotographic printing machine of FIG. 1 is three. The filters are biased into a position to be inserted into the window of the housing member by individual extension springs. When not in operation, the three filters of filter 22 are retained in an inoperative position. The filters are locked into position out of line with the housing window by means of a stop pin which extends up through an opening in the bottom of the housing member into the respective track of each filter. A solenoid arm is association with the stop pin retains the filters in the inoperative position. A selected filter is inserted into the optical path of the housing window by the activation of the appropriate solenoid. By activating the selected solenoid the respective stop pin is moved downward from the track of the appropriate filter, thereby allowing the springs cooperating with the filter in that track to pull the filter into the optical path of the housing window. When a filter is activated into an operative position in the housing window, the filter will remain there throughout the entire scanning of the original document. As previously indicated, lens 22, lens 30, and photochromic filter 24 are adapted to return to the starting position by suitable springs upon completion of the scanning of the original document 26. During the return of the system to the initial position, the first filter is removed from the operative position and a second or subsequent filter is inserted therein.

While the filter of the present invention has been described as requiring a housing member with a window and spring associated with a solenoid to control the movement of the respective filter, one skilled in the art will appreciate that the invention is not necessarily so limited in that any suitable filter mechanism having the requisite filters may be utilized in conjunction with lens 20 and photochromic filter 24. However, it should be noted that this system will only be operable if filter mechanism 22 is interposed between lens 20 and photochromic filter 24.

Preferably, filter mechanism 22 includes three filters, a blue filter, a red filter, and a green filter. Each of the filters is associated with its respective toner particles, i.e. the complement of the color thereof to produce a subtractive system. As heretofore indicated, a green filtered light image is developed with magenta toner particles, a blue filtered light image is developed with yellow toner particles, and a red filtered light image is developed with cyan toner particles.

With continued reference to FIG. 2, light source or lamps 30 include three phosphors having a color balance such that the blue/green ratio is preferably about 0.3 and the red/green ratio is preferably about 0.53. The spectral energy distribution of the red output is about 44 microwatts per centimeter squared, the green output about 82 microwatts per centimeter squared, and the blue output about 25 microwatts per centimeter squared. Lamps 30 operate at about 37 watts, 40 volts, and 1½ amps RMS. The exterior circumferential surface of lamp 30 is opaque with a clear region extending over about a 45° arc thereon. The clear region extends substantially along the entire length of tubularly configured lamp 30. As hereinbefore indicated lamps 30 are triphosphor lamps having peak energy outputs in the region of the blue, green and red wave lengths. The corresponding filters are arranged to permit a light image having a specified bandwidth to pass therethrough. Hence, a blue filter only permits a light image in the blue region to be transmitted therethrough, a red filter only a light image in the red region and a green filter only a light image in the green region. The light image transmitted through filter 22 is transmitted to photochromic filter 24.

Photochromic filter 24 will now be described in detail with continued reference to FIG. 2. Optical system 18 is a spatially selective system that attenuates light energy in a direct relationship to intensity level, high light energies being attenuated to a greater degree than low light energies. Hence, this decreases the bandwidth of the light image transmitted through filter 22. This is achieved through the utilization of photochromic filter 24; a photochromic filter has the general characteristic of darkening when exposed to the light image to pass light images having an intensity below a certain threshold range, while attenuating light image having an intensity above the threshold range and recovering its light transmissive property when the light image is no longer incident thereon. The filter may be used as a spatially selective device with a continuously self-adjusting rejection region. In practice, the single color light image actuates the photochromic material. Photochromic filter 24 is designed to activate or darken in response to the flux level produced by the single color light image. Thus, the photochromic filter 24 darkens in the area of exposure to the light image to attenuate high intensity inputs to a greater degree than low intensity inputs. As shown in FIG. 2, photochromic filter 24 is disposed on lens 20 to move in conjunction therewith. Photochromic filter 24 is formed from a deposit of photochromic material upon a light-transmissive glass plate. The single color light image transmitted through filter 22 actuates the photochromic material deposited on the glass thereof. Hence, the light image darkens photochromic filter 24 to reduce the bandwidth of the light rays transmitted therethrough. It should be noted that the angular velocity of drum 10 must be coordinated with the recovery time required for photochromic filter 24. Hence, a successive single color electrostatic latent image may be formed on photoconductive surface 12 only after photochromic filter 24 recovers its properties from forming the prior latent image.

In this manner, the illumination from lamps 30 may be increased so that photoconductive surface 12 is discharged to substantially the same potential level as it would be without photochromic filter 24. By way of example, when the photochromic filter is not used, lamps 30 discharge the charged photoconductive surface 12 to about 100 volts in the high intensity region. However, in the case of a green filtered light image the bias voltage of developer unit 38 must be set at about 450 volts in order to prevent development in the undesired regions. The low intensity regions will have a charge of about 850 volts remaining thereon. Hence, the voltage gradient producing development is about 400 volts. Contrawise, when photochromic filter 24 is interposed in the light path between filter 22 and photoconductive surface 12, the high intensity light rays are attenuated. Thus, the power furnished to lamps 30 may be increased to the values heretofore indicated so that the high intensity light rays passing through photochromic filter 24 discharge photoconductive surface 12 to about 100 volts. However, in this case a portion of the undesired development has been removed by attenuating the high intensity light rays passing through photochromic filter 24. Thus, the voltage level of developer unit 36 may be reduced to about 300 volts. The low intensity regions will have a charge of about 800 volts remaining thereon. Thus, the voltage gradient producing development is about 500 volts. This is an increase of about 100 volts in voltage gradient, while reducing the bias voltage of the developer unit by about 150 volts. In this manner, image contrast is substantially improved, while trail edge deletion effects, arcing, and carrier bead stickage are substantially eliminated.

Photochromic materials suitable in the practice of this invention are described in U.S. Pat. No. 3,208,860 issued to Armistead in 1964. The optical properties of photochromic glass are discussed in an article by G. K. Megla appearing in Applied Optics Volume 5, No. 6, Page 945 et seq. These teachings, insofar as they are relevant to the present invention are hereby incorporated into this disclosure.

The property of photochromism is known to occur in both organic and inorganic compounds. Some of these compounds lose their reversability after repeated cycles of use; others such as borosilicate glass with silver halide alloy as described in the Armistead patent exhibit no reversability fatigue regardless of the numer of exposures.

One skilled in the art will appreciate that the darkening time and the fade time of the photochromic material employed in the optical system 18 of the present invention is critical. For example, the photochromic material must activate rapidly in response to the first single color light image and fade rapidly in order to respond to the second single color light image. To control the activation rate, it may be desirable to alter the material content of the photochromic filter. It will be readily appreciated by one skilled in the art that by varying the thickness of the photochromic material, favoring the red portion of the spectrum for enhanced fading or favoring the blue/green portion for enhanced darkening, permits a wide range of operating characteristics for this filter.

In recapitulation, it is evident that the optical system utilized in the electrophotographic printing machine hereinbefore described acts as a spatially selective filter that blocks out light energy intensity above a selected threshold value while allowing light energy intensity of a lesser value to pass unimpeded therethrough. This is achieved by a tri-phosphor light source operating in conjunction with a six element split dagor lens and a filter mechanism to form a single color light image which actuates a photochromic filter to permit low intensity inputs to pass therethrough unimpeded, whereas high intensity inputs are substantially attenuated. In this manner, the voltage difference between the charged region on the photoconductive surface and the discharged regions is substantially increased to permit the developer bias to be reduced thereby increasing the voltage differential between. Thus, the electrostatic force attracting the toner particles from the developer unit to the electrostatic latent image is substantially increased, improving image contrast.

While the spatially selective optical system of the present invention has been described as being employed in a multi-color electrophotographic printing machine utilizing dry or powder toner, it is obvious to one skilled in the art that the invention is not necessarily so limited in its use. By way of example, the spatially selective optical system may be employed in an electrostatographic printing machine using liquid development. A printing machine using liquid development is disclosed in U.S. Pat. No. 3,008,115 issued to Gundlach in 1962. Similarly, the spatially selective optical system may be employed in a photoelectrophoretic imaging system. A suitable polychromatic photoelectrophoretic imaging system is described in U.S. Pat. No. 3,384,488 issued to Tulagin in 1968.

It is, therefore, evident that there has been provided in accordance with the present invention, an optical system that fully satisfies the objects, aims and advantages set forth above. While this invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An optical system including:

means for supporting an original document;

a light source in communication with said supporting means for illuminating the original document positioned on said supporting means, said light source comprising at least red, blue and green phosphors with the blue/green ratio being 0.3 and the red/green ratio being 0.53;

lens means for receiving the light rays transmitted from the original document to form a light image thereof;

means for filtering the light image to produce a single color light image; and a normally transparent photochromic filter interposed in the path of the single color light image, said photochromic, filter responsive to the intensity of the single color light image, darkening to automatically regulate the intensity of the single color light image transmitted therethrough and returning to the normally transparent condition when the single color light image is not being transmitted therethrough.

2. A system as recited in claim 1, wherein said photochromic filter attenuates the high intensity light rays transmitted through said filtering means to a greater extent than the low intensity light rays transmitted therethrough.

3. A system as recited in claim 2, wherein said photochromic filter includes borosilicate glass having silver halide crystals therein.

4. A system as recited in claim 1, wherein said filtering means includes:

a blue filter interposed into the light image path to transmit a blue light image therethrough;

a green filter interposed into the light image path to transmit a green light image therethrough; and a red filter interposed into the light image image to transmit a red light imaage therethrough.

5. An electrophotographic printing machine of the type having a photoconductive surface, including:

means for charging the photoconductive surface;

means for creating a light image of an original document;

means for filtering the light image to produce a single color light image; and a normally transparent photochromic filter interposed between the photoconductive surface and said filtering means in the path of the single color light image, said photochromic filter, responsive to the intensity of the single color light image, darkening to automatically regulate the intensity of the single color light image transmitted therethrough for irradiating the charged photoconductive surface to selectively dissipate the charge thereon in accordance with the intensity of the single color light image passing through said photochromic filter, said photochromic filter attenuating the high intensity light rays transmitted through said filtering means to a greater extent than the low intensity light rays transmitted therethrough and returning to the normally transparent condition when the single color light image is not being transmitted therethrough.

6. A printing maching as recited in claim 5, wherein said photochromic filter includes borosilicate glass having silver halide crystals therein.

7. A printing machine as recited in claim 5 wherein said light image creating means includes:

a light source for illuminating the original document; and lens means for receiving the light rays from the original document to form a light image thereof.

8. A printing machine as recited in claim 7, wherein said light source includes at least red, blue, and green phosphors with the blue/green ratio being 0.3 and the red/green ratio being 0.53.

9. A printing machine as recited in claim 8 wherein said filtering means includes:

a blue filter interposed into the light image path to transmit a blue light image therethrough;

a green filter interposed into the light image path to transmit a green light image therethrough; and a red filter interposed into the light image path to transmit a red light image therethrough.

* * * * *